US005638793A

United States Patent [19]

Rapp et al.

[11] Patent Number: 5,638,793

[45] Date of Patent: Jun. 17, 1997

[54] FUEL-INJECTION PUMP FOR INTERNAL-COMBUSTION ENGINES

[75] Inventors: Karl Rapp, Stuttgart; Alexander Tyrolt, Denkendorf; Karsten Hummel, Beilstein; Werner Faupel, Gerlingen; Hans-Joachim Peters, Stuttgart, all of Germany

[73] Assignee: Robert Bosch GmbH, Stuttgart, Germany

[21] Appl. No.: 569,775

[22] Filed: Dec. 8, 1995

[30] Foreign Application Priority Data

Dec. 9, 1994 [DE] Germany ..... 44 43 860.5

[51] Int. Cl.[6] ..... F02M 37/04; F04B 7/04

[52] U.S. Cl. ..... 123/500; 123/198 DB; 417/499

[58] Field of Search ..... 123/500, 501, 123/198 DB; 417/499, 494, 490

[56] References Cited

U.S. PATENT DOCUMENTS

| | | | |
|---|---|---|---|
| 1,966,694 | 7/1934 | Vaudet | 123/501 |
| 2,159,177 | 5/1939 | Ricardo | 123/501 |
| 2,565,681 | 8/1951 | Fleck | 123/501 |
| 3,930,482 | 1/1976 | Akashi | 417/499 |
| 4,013,055 | 3/1977 | Sommer | 123/501 |
| 4,881,506 | 11/1989 | Hoecker | 123/500 |
| 4,897,024 | 1/1990 | Hatz | 417/494 |
| 5,097,812 | 3/1992 | Augostin | 417/494 |
| 5,219,280 | 6/1993 | Yashiro | 123/500 |
| 5,396,871 | 3/1995 | Faupel | 123/500 |
| 5,487,651 | 1/1996 | Guentert | 123/500 |

FOREIGN PATENT DOCUMENTS

| | | | |
|---|---|---|---|
| 1164392 | 10/1958 | France | 123/501 |
| 2045556 | 10/1979 | Germany | 123/501 |

*Primary Examiner*—Carl S. Miller

*Attorney, Agent, or Firm*—Edwin E. Greigg; Ronald E. Greigg

[57] ABSTRACT

A fuel injection pump for internal combustion engines in which to control the fuel injection quantities with the internal combustion engine cold, a first control edge is provided. For controlling the start of fuel injection with the internal combustion engine hot, a second control edge and a third control edge are provided. Assigned to respective control edges are provided a first and second oblique control edge, by means of which an effective pump piston feed stroke is controlled according to the rotary position of the pump piston. To switch off the internal combustion engine, in the region of transition from the first control edge to the second control edge the assignment of this second control edge to the second oblique control edge is provided in such a way that injection ceases on account of an overlap with a control port. This measure is assisted by an additional longitudinal groove which, in this rotary position, is in overlap with an additional control port, this additional longitudinal groove being the extension of a longitudinal groove, via which a pump working space is relieved during the operation of the internal combustion engine and after a reopening of the control ports by the oblique control edges.

14 Claims, 1 Drawing Sheet

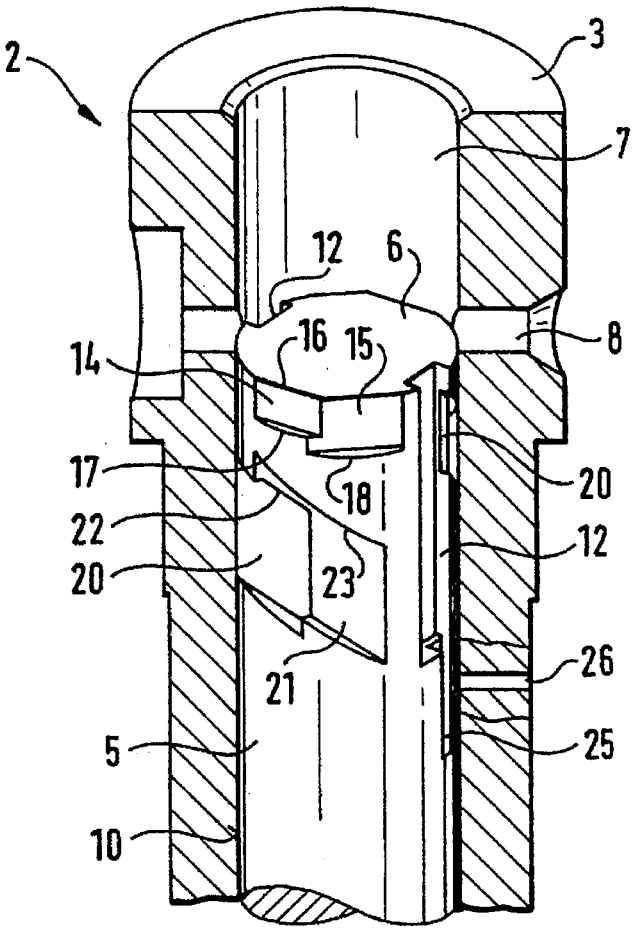
FIG. 1
FIG. 2
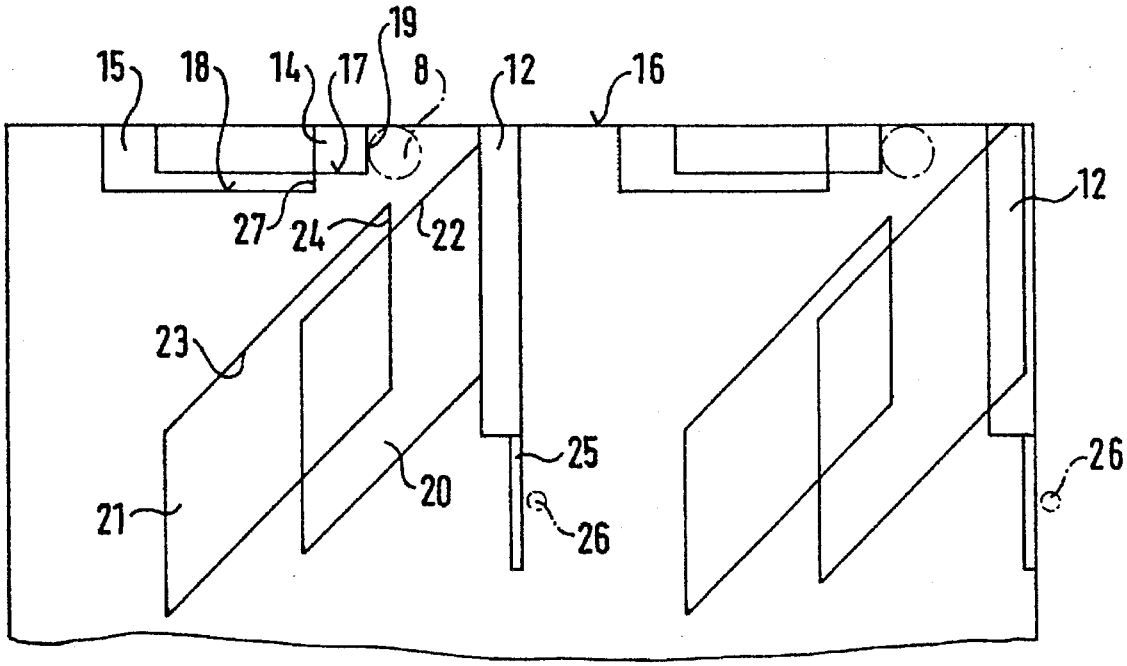

FUEL-INJECTION PUMP FOR INTERNAL-COMBUSTION ENGINES

STATE OF THE ART

The invention proceeds from a fuel-injection pump as set forth hereinafter. In such a fuel-injection pump known from German Patent DE 4,225,803, a longitudinal groove is arranged in the outer surface of the pump piston between a first control edge and a second control edge, the said longitudinal groove constantly connecting the pump working space to the recess delimited by the oblique control edge and taking the form of an annular groove. The latter separates the control-edge region provided for a hot-running internal-combustion engine from the control region provided for running with a cold internal-combustion engine. This longitudinal groove constitutes a stop groove, by means of which, with the internal-combustion engine running hot, the internal-combustion engine can be brought to a standstill, without having to pass over the injection-quantity range having a high injection quantity and provided for running with a cold internal-combustion engine. As a result of this stop groove, a specific rotary-angle range of a pump piston is occupied and therefore the possible regulating rotary-angle range of the pump piston is restricted. This is a disadvantage particularly also when the pump piston has a double-flow design, that is to say when two control bores are activated simultaneously by control edges and oblique control edges corresponding to one another.

ADVANTAGES OF THE INVENTION

In contrast to this, the advantage of the fuel-injection pump according to the invention is that, on the one hand, it is possible, in the range of fuel-injection quantity control for the hot-running internal-combustion engine, to bring about a plurality of start-of-the-injection ranges, the mutually offset oblique control edges, in conjunction with the given diameter of the control port, achieving a smooth transition between the fuel-injection quantity setting at the end of one range and the fuel-injection quantity setting at the start of the other range. The design according to the invention, particularly in conjunction with the control edge offset relative to the first control edge and with the oblique control edge offset relative to the first oblique control edge, in cooperation with the control port and the additional longitudinal groove with the additional control port, ensures that, without an interruption in the control ranges between the hot-running internal-combustion engine and cold internal-combustion engine, with the assignment to the first control edge no intermediate groove reducing the regnlating travel has to be provided and, nevertheless, a stop effect is achieved in the range between these said operating ranges, with a zero feed. Via the additional longitudinal groove with the additional control port and the overlap of the control edge offset relative to the first control edge with the oblique control edge offset relative to the first oblique control edge via the control port, there is a sufficiently large available flow-off cross-section, via which the pump working space can be effectively relieved of pressure and injection is thus terminated.

BRIEF DESCRIPTION OF THE DRAWING

An exemplary embodiment of the subject of the invention is represented in the drawing and explained in more detail below. FIG. 1 shows a cutout from a fuel-injection pump having the design according to the invention of the pump piston and pump cylinder, and FIG. 2 shows a developed view of the outer surface of the pump piston in the region of the control edges and oblique control edges with associated control bores.

DESCRIPTION OF THE EXEMPLARY EMBODIMENT

FIG. 1 shows a so-called pump element comprising a cylinder liner 3 which forms a pump cylinder 2 and which is conventionally inserted into a housing of an in-line fuel-injection pump not shown any further. Guided sealingly displaceably in this pump cylinder 2 is a pump piston 5 which is driven to and fro by a cam drive, not shown further, synchronously with the rotational speed of the associated internal-combustion engine and which can be rotated by means of a regulating device, not shown, in order to set the fuel-injection quantity per pump-piston stroke. This can take place by means of a mechanical regulator or by means of an electronically controlled regulator. Such regulators are known and therefore need not be shown in more detail in the present application.

The pump piston moving to and fro in the pump cylinder 2 encloses with its end face 6, in the pump cylinder, a pump working space 7. For this purpose, the cylinder liner 3 inserted into the associated in-line fuel-injection pump is closed on the end face in a way not shown here and, on this end face, has an injection conduit, likewise not shown further here, which leads to the associated fuel-injection valve on the internal-combustion engine, to which fuel-injection valve the pump piston 5 feeds fuel under injection pressure during its feed stroke. Provided in the cylinder liner are two control ports 8 which are located diametrically opposite one another and which connect the pump cylinder to a fuel low-pressure space surrounding the cylinder liner 3. During the suction stroke of the pump piston, after its end face 6 has opened the connection of the control ports 8 to the inside of the pump cylinder, the pump working space is supplied with fuel from the said fuel low-pressure space. During the upstroke after the control ports have been closed, a high fuel pressure can then build up in the pump working space and, when the injection pressure set on the fuel-injection valve is exceeded, the fuel is injected. This injection is terminated when the control ports are opened again by a control edge of the pump piston and, at the same time, a connection between the pump working space 7 and the control ports is made. The greater the stroke of the pump piston between the closing of the control ports 8 and their reopening, the greater the fuel quantity being injected.

To control the fuel-injection quantity, the pump piston has in its outer surface 10 two longitudinal grooves which are located diametrically opposite one another and which open into the end face 6 of the pump piston. Furthermore, the outer surface of the pump piston has worked into it, in each case, two first ground-down portions 14 located diametrically opposite one another and two second ground-down portions 15 located diametrically opposite one another, said first and second ground-down portions being of different depth, starting from the end face 6 of the pump piston, as seen in the longitudinal direction of the pump axis. These ground-down portions can be seen more clearly particularly in FIG. 2 which is a developed view of the pump piston. The first ground-down portion 14, adjacent to the longitudinal groove 12 on the left, is made adjacent to a first control edge 16. The first ground-down portion is placed horizontally in such a way that it forms, together with the outer surface of the pump piston, a second control edge 17 which, like the first control edge, extends in a radial plane relative to the axis of the pump piston, but is shifted away from the end face 6 of the first control edge 16 towards the drive side of the pump piston. The transition is formed in the circumferential direction by a limiting edge 19 of the first ground-down portion, the said limiting edge extending parallel to the axis of the pump piston. The second ground-down portion 15 partially overlaps the first ground-down portion 14 and is designed with a larger width, in such a way that it forms, together with the outer surface of the pump piston, a third control edge 18 which is shifted even further from the second control edge away from the end face of the pump piston towards the drive side, with an axis-parallel transition 27. Depending on the rotary position of the pump piston, the control ports 8 shown in FIG. 2 cooperate either with the first, the second or the third control edges. As a result, with an increasing rotation of the pump pison to the right, an increasingly later closing of the control ports 8 by control edges 16 to 18 is achieved.

The reopening of the control ports 8 takes place by means of the control edges of a third ground-down portion 20 and of a fourth ground-down portion 21 which are likewise in each case formed diametrically opposite one another in pairs. These ground-down portions in the outer surface of the pump piston are made oblique to the pump-piston axis. The third ground-down portion intersects the longitudinal groove 12 and forms a first oblique control edge 22 towards the side of the end face of the pump piston. The fourth ground-down portion is adjacent thereto at a distance from the longitudinal groove after a specific rotary-angle range and, at the same time, is arranged offset in such a way that a limiting edge formed by the said fourth ground-down portion and pointing toward the end face 6 forms a second oblique control edge 23 which is offset parallel to the first oblique control edge towards the pup-piston end face and merges with an axis-parallel limiting edge 24 into the first control edge 22. As seen in the circumferential direction of the pump piston, the limiting edges 24 are at a greater distance from the limiting edges 27 than the width or diameter of the control ports 8.

Worked into the outer surface in each case an additional longitudinal groove 25 which axially adjoins the end of the longitudinal groove 12 and is made substantially narrower and which cooperates in each case with an additional control port 26 in the cylinder liner. The control ports 26, like the control ports 8 too, connect the interior of the pump cylinder to a fuel low-pressure space. They are offset in the circumferential direction relative to the control ports 8.

By means of the design provided here, a subdivision of the operation of a fuel-injection quantity with different injection times and injection quantities, both in a cold internal-combustion engine and in a hot-running internal-combustion engine, is possible, at the same time taking into account the requirements of the 5 internal-combustion engine for fuel injection in these operating ranges. In the position shown in FIG. 2, the pump piston 5 is in a rotary position corresponding to operation in a still cold internal-combustion engine shortly before transition to operation in a hot internal-combustion engine. In the range when the internal-combustion engine is cold, the control port 8 cooperates with the first control edge 16 which determines the start of high-pressure feed. When the first control edge 16 has passed over the port 8, injection takes place, this being terminated when the first oblique control edge 22 opens the control port towards the third ground-down portion 20. The latter then makes a connection from the pump working space 7 via the longitudinal groove 12 and the control port 8 to the fuel low-pressure side. At the same time, the pump working space 7 is relieved and the high-pressure injection of fuel is interrupted. The remaining fuel fed by the pump piston flows off towards the fuel low-pressure space, without injection taking place.

When the associated control devices recognizes that the internal-combustion engine is running hot, the pump piston is moved further, in such a way that the control ports 8 now come into the effective range of the second control edges 17. As a result of their axial distance from the end face 6, the start of high-pressure feed takes place at a later point in time, thus signifying an adjustment of the start of injection. When the control port 8 is subsequently closed after the second control edge 17 has passed over it, high-pressure injection then takes place, as before, and this is terminated when the second oblique control edge 23 preceding the first oblique control edge 22 towards the end face of the pump piston makes a connection between the control port 8 and the fourth ground-down portion 21. The latter is connected to the third ground-down portion such a way that, here too, a relief of the pump working space via the longitudinal groove 12, the third ground-down portion 20 and the fourth ground-down portion 21 as well as the control port 8 to the low-pressure space takes place. The smallest pump-piston stroke effective for injection in a position of the control port towards the side of the longitudinal groove 12 in the region of this second oblique control edge 23 can be smaller than the stroke effective for the injection with the internal-combustion engine still cold, when the control port is located in the region of the first control edge 16. In this operating mode with a cold internal-combustion engine, an excess quantity of fuel is necessary in order to guarantee the operation of the internal-combustion engine.

By means of the third control edge 18, it is possible to achieve an even later start of injection, particularly in the case of a high load. According to the rotary position of the pump piston, the third control edge 18 then cooperates with the the control port 8 which, after the feed stroke, is once again opened by the second oblique control edge 23.

Such measures for advancing the start of injection can be further refined if additional ground-down portions are provided. However, limits are placed on this on the grounds of the overflow cross-sections which are necessary for relieving the pump working space. If the overflow cross-sections are too small, this results in undesirable throttle effects which, with an increasing rotational speed, become noticeable in an unintended increase in the feed duration and consequently in an unintended increase in the fuel-injection quantity.

In order to stop an internal-combustion engine again, regular use is made of the longitudinal groove 12 which, in known designs, is provided for this purpose. For switching off, the pump piston is then rotated to the left, so that the control ports 8 would come into connection with the longitudinal groove 12. In the event of a subdivision into a working range for a cold internal-combustion engine and for a hot internal-combustion engine, if the longitudinal groove were used as a common stop groove the entire cold control range would have to be traversed. This is not desirable and, moreover, also loads the regulating capacity of the regulator. It is necessary also to have a switch-off possibility in the transitional range between a hot-running internal-combustion engine and a cold internal-combustion engine, as in the state of the art mentioned in the introduction. In the present case, the design of ground-down portions 14 and ground-down portions 20 and 23 is such that, in the transitional range between the first control edge and the second control edge 17, there is a position for the control port 8, in which the latter, between the state of not yet being closed by the control edge 17 and the state of being reopened by the second oblique control edge 23, in the intermediate range constantly makes a connection between the fourth ground-down portion 21 and the first ground-down portion 14. For reasons of space, however, this connection is still throttled to an undesirable extent, so that, at a high rotational speed, some pressure can nevertheless build up in the pump working space and can lead to the injection of small injection quantities. For this position which corresponds virtually to the stop position for switching off the internal-combustion engine, the additional longitudinal grooves 25 are now additionally provided, these coming in this range into overlap with the additional control ports 26. This provides an additional flow-off cross-section, the result of which is now that injection is completely prevented in this rotary position of the pump piston. At the same time, the advantage of the additional longitudinal groove is that it is in a region of the outer surface of the pump piston which is non-critical for the regulation of the fuel-injection quantity.

The reduced width of the additional control port 26 and of the additional longitudinal groove 25 guarantees that the longitudinal groove 25 is connected to the control port 26 only in this narrow range where a switch-off of the internal-combustion engine is desired. Immediately thereafter, control of the fuel-injection quantity, with the internal-combustion engine running hot, can then take place by a utilization of a maximum possible regulating range.

The foregoing relates to preferred exemplary embodiments of the invention, it being understood that other variants and embodiments thereof are possible within the spirit and scope of the invention, the latter being defined by the appended claims.

We claim:

1. A fuel injection pump for internal combustion engines, comprising pump cylinder (2), a pump piston (5) which is driven to and fro in the pump cylinder (2) and is rotatable by means of a control device and which encloses with its end face (6), in the pump cylinder (2), a pump working space (7) which is connected to a fuel injection valve and which is connected to a low pressure fuel space by at least one control port (8) arranged in an outer surface (10) of the pump cylinder (2), said at least one control port serving for filling and relieving the pump working space (7), said control port (8), at a start of a feed stroke of the pump piston (5), is closed by a control edge (16, 17, 18) arranged on one end face of the pump piston and, at another end of the feed stroke of the pump piston, is reopened by an oblique control edge (22, 23) on said pump piston which extends obliquely relative to an axis of the pump piston (5) and is a limiting edge of a recess (20, 21) which merges circumferentially into a longitudinal groove (12) connected continuously to the pump working space (7) and is located in the outer surface (10) of the pump piston (5), the control edge on the end face (6) of the pump piston comprising a first control edge (16) which has adjoining said first control edge in the direction of increasing distance of the oblique control edge from the end face (6), at least one additional control edge (17, 18) offset relative to the first or the preceding control edge (16), and at least one additional oblique control edge (23) which is assigned to the additional control edge (17, 18) and which is offset relative to the first oblique control edge (22) towards the end face (6) of the pump piston (5), with a transitional edge (24) extending in alignment with the axis of the pump piston and located, in relation to a circumference of an outer surface, in a region of the edge (19), likewise extending in alignment with the axis of the pump piston (5), between the first control edge (16) and additional control edge (17), of which the distance from the transitional edge (24) in the circumferential direction is smaller than the width of the control port (8) in the circumferential direction, the extent of the control port (8) in alignment with the pump-piston axis being greater than a smallest distance between the additional control edge (17) following the first control edge (16) and the additional oblique control (23) following the first oblique control edge (22), at its transition to the first oblique control edge (22), and with an additional control port (26) which is provided in the wall of the pump cylinder (2) and which overlaps an additional longitudinal groove (25), starting from the longitudinal groove (12) in the axial direction, when the control port (8) is located, in relation to the circumference of the outer surface, in the region of a transition between the first control edge (16) and the following additional control edge (17) and of a transition between the first oblique control (22) and the following additional oblique control edge (23).

2. A fuel injection pump according to claim 1, in which the control edges (16, 17, 18) extend in the radial plane relative to the axis of the pump piston (5).

3. A fuel injection according to claim 1, in which the oblique control edges (22, 23) extend parallel to one another, the first oblique control edge (22) serving for controlling the fuel injection when the internal combustion engine is running cold, and the at least one additional oblique control edge (23) serving for controlling the fuel injection when the internal combustion engine is running hot, and the control port (8) being brought into the effective range of the respective oblique control edge (22, 23) by the control device.

4. A fuel injection according to claim 1, in which in order to switch off the internal combustion engine by means of zero feed, the pump piston (5) is rotated by the control device in such a way that the control port (8) is effective, in relation to the circumference of the outer surface, in the region of a transition between the first control edge (16) and the following additional control edge (17) and of a transition between the first oblique control edge (22) and the following additional oblique control edge (23).

5. A fuel injection according to claim 2, in which in order to switch off the internal combustion engine by means of zero feed, the pump piston (5) is rotated by the control device in such a way that the control port (8) is effective, in relation to the circumference of the outer surface, in the region of a transition between the first control edge (16) and the following additional control edge (17) and of a transition between the first oblique control edge (22) and the following additional oblique control edge (23).

6. A fuel injection according to claim 3, in which in order to switch off the internal combustion engine by means of zero feed, the pump piston (5) is rotated by the control device in such a way that the control port (8) is effective, in relation to the circumference of the outer surface, in the region of a transition between the first control edge (16) and the following additional control edge (17) and of a transition between the first oblique control edge (22) and the following additional oblique control edge (23).

7. A fuel injection according to claim 1, in which two control bores (8) located diametrically opposite one another and two additional control bores (26) located diametrically opposite on one another are provided in the pump cylinder (2), in each case with control edges (16, 17, 18) and oblique control edges (22, 23) assigned to these control bores.

8. A fuel injection according to claim 2, in which two control bores (8) located diametrically opposite one another and two additional control bores (26) located diametrically opposite on one another are provided in the pump cylinder (2), in each case with control edges (16, 17, 18) and oblique control edges (22, 23) assigned to these control bores.

9. A fuel injection according to claim 3, in which two control bores (8) located diametrically opposite one another and two additional control bores (26) located diametrically opposite on one another are provided in the pump cylinder (2), in each case with control edges (16, 17, 18) and oblique control edges (22, 23) assigned to these control bores.

10. A fuel injection according to claim 4, in which two control bores (8) located diametrically opposite one another and two additional control bores (26) located diametrically opposite on one another are provided in the pump cylinder (2), in each case with control edges (16, 17, 18) and oblique control edges (22, 23) assigned to these control bores.

11. A fuel injection according to claim 5, in which two control bores (8) located diametrically opposite one another and two additional control bores (26) located diametrically opposite on one another are provided in the pump cylinder (2), in each case with control edges (16, 17, 18) and oblique control edges (22, 23) assigned to these control bores.

12. A fuel injection according to claim 6, in which two control bores (8) located diametrically opposite one another and two additional control bores (26) located diametrically opposite on one another are provided in the pump cylinder (2), in each case with control edges (16, 17, 18) and oblique control edges (22, 23) assigned to these control bores.

13. The fuel injection pump according to claim 7, in which said control bores (8) and said control bores (26) are off-set with respect to each other.

14. The fuel injection pump according to claim 8, in which said control bores (8) and said control bores (26) are off-set with respect to each other.

* * * * *